US007919720B2

(12) United States Patent
Shimizu et al.

(10) Patent No.: US 7,919,720 B2
(45) Date of Patent: Apr. 5, 2011

(54) EARTHING SWITCH

(75) Inventors: Yoshinori Shimizu, Tokyo (JP); Masahito Tanaka, Tokyo (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 661 days.

(21) Appl. No.: 12/000,431

(22) Filed: Dec. 12, 2007

(65) Prior Publication Data

US 2009/0045170 A1 Feb. 19, 2009

(30) Foreign Application Priority Data

Aug. 13, 2007 (JP) ..... 2007-211030

(51) Int. Cl.
*H01H 33/70* (2006.01)

(52) U.S. Cl. ..... 218/62; 218/57; 218/55

(58) Field of Classification Search ..... 218/43, 218/45, 48, 55, 57–61, 67, 68, 78–80, 84, 218/153, 154
See application file for complete search history.

(56) References Cited

U.S. PATENT DOCUMENTS

| | | | | |
|---|---|---|---|---|
| 4,562,319 | A | 12/1985 | Badon et al. | |
| 4,864,286 | A | 9/1989 | Ohshita et al. | |
| 5,902,979 | A | 5/1999 | Kim | |
| 5,977,502 | A * | 11/1999 | Mizoguchi et al. | 218/43 |

FOREIGN PATENT DOCUMENTS

| | | |
|---|---|---|
| CA | 1131679 | 9/1982 |
| CA | 2198549 | 8/1998 |
| JP | 5-114337 A | 5/1993 |

OTHER PUBLICATIONS

Office Action issued in the corresponding Canadian Patent Application No. 2,625,108 dated May 4, 2010.

* cited by examiner

*Primary Examiner* — Renee Luebke
*Assistant Examiner* — Marina Fishman
(74) *Attorney, Agent, or Firm* — Buchanan Ingersoll & Rooney PC

(57) ABSTRACT

In an earthing switch a release mechanism releases pressure stored in a puffer type arc cancelling chamber by releasing the chamber at a predetermined area toward a stationary contact unit during a full stroke extent of a movable contact unit so that the puffering operation can be deterred from execution.

8 Claims, 6 Drawing Sheets

EARTHING SWITCH

BACKGROUND OF THE INVENTION

1. Field of the Invention

The present invention relates to a high-speed puffer-type earthing switch.

2. Description of the Related Art

Conventional puffer-type earthing switches have a slit on a lever of a guide cylinder with the aim of lowering the operating energy when driving the guide cylinder. The slit begins from an end of the lever of the guide cylinder and extends up to the halfway of the piston stroke range. When a movable contact retreats up to a predetermined position in the course of opening an earthing switch, insulating gas stored in the guide cylinder leaks through the slit, thereby causing the pressure in the guide cylinder to become equal to the surrounding atmospheric pressure. In consequence, operating energy is lowered in the latter half cycle of the opening operation. For details, refer to the Japanese Patent Application Laid-Open No. H05-114337 for example.

High-speed puffer-type earthing switches are used in ultra-high voltage transmission lines, which dealing with 1000 KV for example, to prevent the transmission lines from being disconnected when earthing occurs accidentally. Specifically, one high-speed puffer-type earthing switch is arranged on each end of the transmission line to forcibly cancel the secondary arc current that is produced when the earth current is cut off to enable the transmission line to be closed again at a high speed.

In the conventional puffer-type earthing switches in the latter half cycle of an actuating operation, load remained as it was without causing the operating energy to be lowered at all. On the other hand, in the high-speed puffer-type earthing switches, although the current breaking performance is important, it is more important that the duty of short-circuit actuating performance be satisfied during an actuating operation. In other words, higher arc-cancelling capability at an appropriate location and faster actuating speed are concurrently required in the high-speed puffer-type earthing switches.

SUMMARY OF THE INVENTION

It is an object of the present invention to at least partially solve the problems in the conventional technology.

According to an aspect of the present invention, an earthing switch includes a container filled with insulating gas; a stationary contact unit firmly secured to an interior of the container; a movable contact unit, an end of which is capable of moving toward or away from the stationary contact unit; a lever coupled with other end of the movable contact unit; a puffer cylinder that is arranged coaxially around the movable contact unit; a puffer piston integrated with the movable contact unit and defines an arc cancelling chamber in conjunction with the puffer cylinder, wherein the puffer piston slides along the inner wall surface of the puffer cylinder in the axial direction so as to exert puffering function by causing insulating gas to be absorbed into the arc cancelling chamber via a clearance between the movable contact unit and the stationary contact unit and also by causing the insulating gas in the arc cancelling chamber to blow out via the clearance between the movable contact unit and stationary contact unit; and a release mechanism that releases pressure stored in the puffer type arc cancelling chamber by releasing the chamber at a predetermined area toward the stationary contact unit during a full stroke extent of the movable contact unit so that the puffering operation can be deterred from execution.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of a puffer-type earthing switch according to the present invention are described below while referring to the accompanying diagrams. It should be understood that the scope of the present invention is not solely limited to the embodiments described below.

Figure 1:
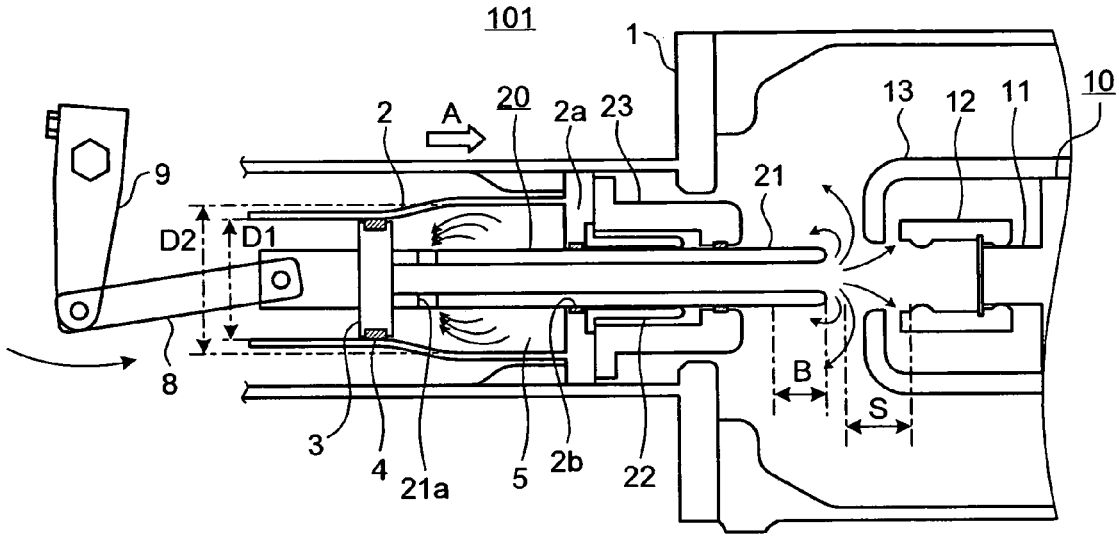
FIG. 1 is a side view of a puffer-type earthing switch according to a first embodiment of the present invention at the time of the first half cycle of an actuating operation.
Figure 2:
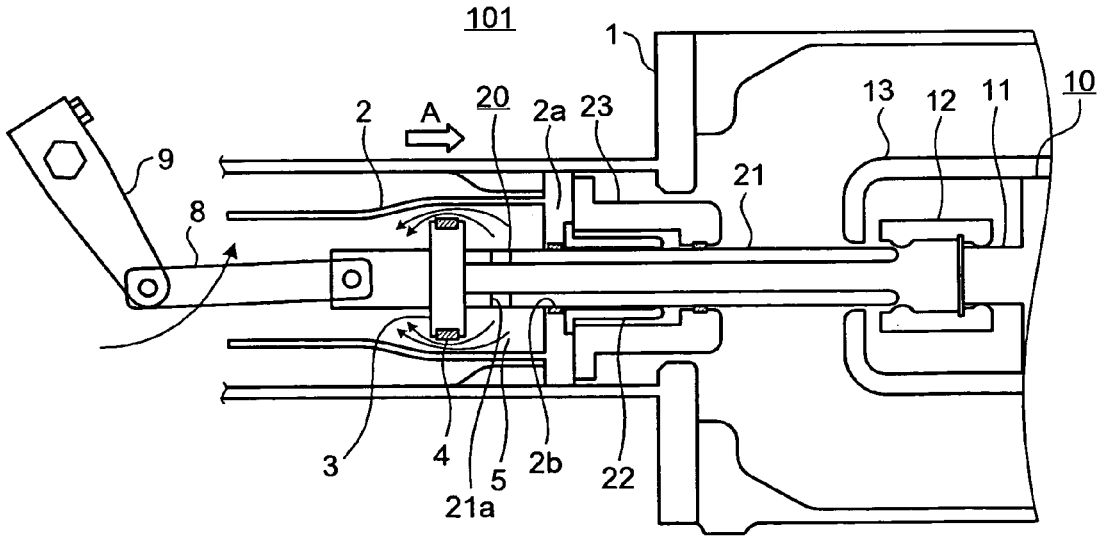
FIG. 2 is a side view of the puffer-type earthing switch shown in FIG. 1 at the time of the later half cycle of the actuating operation.
Figure 3:
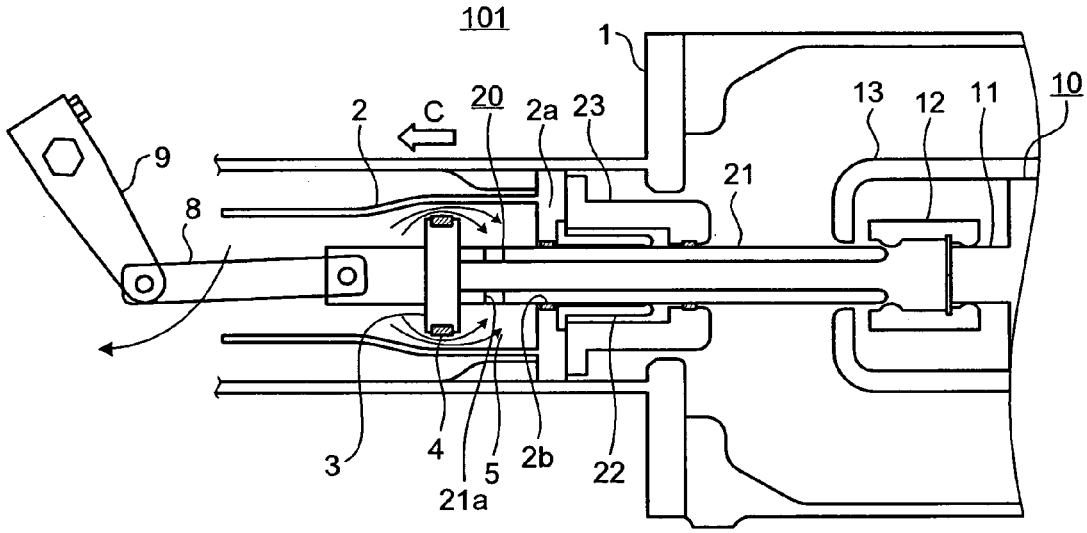
FIG. 3 is a side view of the puffer-type earthing switch shown in FIG. 1 at the time of the first half cycle of an opening operation.
Figure 4:
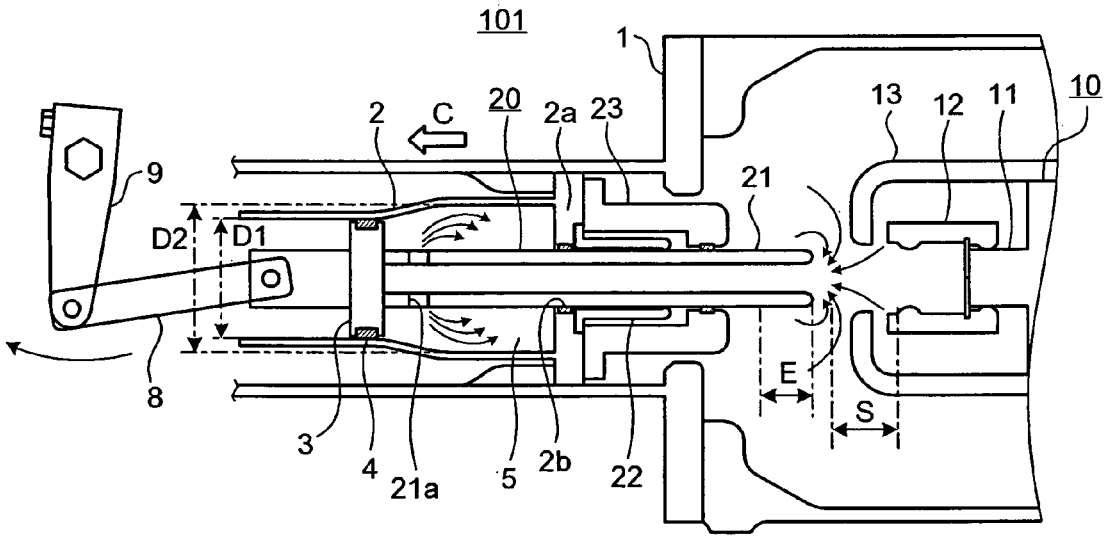
FIG. 4 is a side view of the puffer-type earthing switch shown in FIG. 1 at the time of the later half cycle of the opening operation.

FIG. 1 is a side view of a puffer-type earthing switch 101 according to a first embodiment of the present invention at the time of the first half cycle of an actuating operation, FIG. 2 is a side view of the puffer-type earthing switch 101 at the time of the later half cycle of the actuating operation, FIG. 3 is a side view of the puffer-type earthing switch 101 at the time of the first half cycle of an opening operation, and FIG. 4 is a side view of the puffer-type earthing switch 101 at the time of the later half cycle of the opening operation. The puffer-type earthing switch 101 includes a gas container 1, a stationary contact unit 10, and a movable contact unit 20. The gas container 1 is filled with insulating gas such as sulfur hexafluoride. The stationary contact unit 10 is located inside the gas container 1 and it does not move. The movable contact unit 20 is held such that it can move toward or away from the stationary contact unit 10.

The stationary contact unit 10 includes an electrode 11 and a contact 12. The electrode 11 is connected to a main circuit conductor (not shown). The contact 12 is attached at the tip portion of the electrode 11. The contact 12 is concealed with a shield 13 to attenuate the electric field produced by the contact 12.

The movable contact unit 20 includes a slender and elongated movable cylindrical electrode 21 that extends toward the movable contact unit 20, and a contact 22 that is arranged around the movable electrode 21 and makes an electric contact with the movable electrode 21 so as to collect current from the movable electrode 21. The contact 22 is earthed via a grounding conductor (not shown). The contact 22 is concealed with a shield 23 to attenuate the electric field produced by the contact 22.

A cylindrical puffer cylinder 2 having a bottom is arranged coaxially around the movable contact unit 20. A slidable puffer piston 3 is arranged inside the puffer cylinder 2. A sealing member 4 such as a sleeve, made of for example "TEFLON" (Registered Trademark), is provided around the puffer piston 3 so that inside of the puffer cylinder 2 is airtight.

An end of the movable electrode 21 is attached to the puffer piston 3. Holes 21*a* are formed in the puffer piston 3 at a portion near the puffer piston 3. The other end of the movable electrode 21 protrudes through a hole 2*b* in a facet 2*a* of the puffer cylinder 2 and extends inside the stationary contact unit 10. The contact 22 and the shield 23 are firmly attached to the facet 2*a*. Sealing members provided in the hole 2*b* and in the shield 23 hold the movable electrode 21 movably and airtightly. An arc cancelling chamber 5 is defined by the puffer cylinder 2, the puffer piston 3, and the facet 2*a*.

A lever 9 is coupled via a link 8 to an end of the puffer piston 3 that is away from the movable contact unit 20. An oil-pressurized operating cylinder (not shown) is connected to the lever 9. Accordingly, as the oil-pressurized operating cylinder operates the lever 9, the puffer piston 3, i.e., the movable electrode 21, moves toward or away from the movable contact unit 20.

An inner diameter D2 of one portion of the puffer cylinder 2 near the facet 2*a* is greater than an inner diameter D1 of other portion of the puffer cylinder 2. Because of such a shape, the puffer cylinder 2 constitutes a release mechanism. That is, the arc cancelling chamber 5 is opened when the puffer piston 3 is in the wider portion, and the arc cancelling chamber 5 is closed when the puffer piston 3 is in the narrower portion. In other words, in one stroke of the puffer piston 3 the arc cancelling chamber 5 is once opened and once closed. Pressure is released from the arc cancelling chamber 5 when it is open, and pressure is built inside the arc cancelling chamber 5 when it is closed. The transition of the arc cancelling chamber 5 from the wider portion to the narrower portion takes place in a portion that deviates a little bit toward the lever 9 from a portion where electric arc is generated between the movable contact unit 20 (i.e., the movable electrode 21) and the stationary contact unit 10.

The operation of the puffer-type earthing switch according to the present invention is described below. First, an earthing operation performed by the puffer-type earthing switch 101 is described. When earthing occurs accidentally in a transmission line (not shown), breakers (not shown) disposed on both sides of the transmission line are released whereby no faulty current flows in the transmission line. Moreover, an actuating command is sent to the puffer-type earthing switch 101. In response to the actuating command, the oil-pressurized operating cylinder operates the lever 9 so that it rotates in the direction shown by an arrow in FIG. 1. As the lever 9 rotates, the puffer piston 3 and the movable electrode 21 move in the direction shown by an arrow A. Accordingly, as shown in FIG. 2, the movable electrode 21 is brought in electric contact with the contact 12 of the stationary contact unit 10 thereby closing the puffer-type earthing switch 101.

In consequence, faulty inductive current is led from a main circuit conductor (not shown) to the following conductors in order of the electrode 11, the contact 12, the movable electrode 21, the contact 22, and a grounding conductor (not shown) before being grounded. After fully completing the actuating operation, the oil-pressurized operating cylinder operates the lever 9 so that, as shown in FIG. 3, the puffer piston 3 moves in the direction shown by an arrow C. Hence, as shown in FIG. 4, the movable electrode 21 departs from the contact 12 to enable the puffer-type earthing switch 101 to restore the open state.

An arc cancelling operation at the time of an actuating operation will be explained below. As shown in FIG. 1, when the puffer piston 3 moves in the direction of the arrow A, the arc cancelling chamber contracts, so the pressure inside the arc cancelling chamber 5 rises whereby insulating gas is forced from the arc cancelling chamber 5 via the holes 21*a*. The insulating gas passes through the movable electrode 21 and it is blown out from the tip of the movable electrode 21. The blown-out insulating gas is directed toward a hot space S, in which arc cancelling capability remains low, between the movable electrode 21 and the contact 12 shown in FIG. 1 thereby cancelling an electric arc current that may have been generated in the space S. When the tip of the movable electrode 21 moves in a space B shown in FIG. 1 after complete actuation of the earthing switch, electric arc current is generated in the space S. However, the electric arc current is effectively cancelled by the insulating gas blown out from the tip of the movable electrode 21.

After causing the puffer piston 3 to be shifted further in the arrowed direction A to pass by the location of the differently enlarged external diametrical configuration of the puffer cylinder 2, as shown in FIG. 2, the insulating gas stored in the arc cancelling chamber 5 is led towards the lever 9 by detouring around the puffer piston 3. In consequence, pressure in the arc cancelling chamber 5 is lowered to a level almost the same as that of the surrounding atmospheric pressure, in other words, the pressure is externally released. Thenceforth, the pressure is no longer strengthened in the arc cancelling chamber 5. Due to this reason, the puffer piston 3 is merely subject to insubstantial operating energy, thereby enabling the movable electrode 21 to be shifted in the direction of the stationary contact unit 10 at a faster speed. In consequence, the puffer-type earthing switch 101 is actuated much faster, thereby enhancing the performance in actuating the short circuit operation.

The following description refers to an arc cancelling operation to be performed during a contact parting (opening) operation. As shown in FIG. 3, when the puffer piston 3 moves in the direction of the arrow C by rotating the lever 9 in the arrowed clockwise direction, as shown in FIG. 3, insulating gas in the arc cancelling chamber 5 detours around the puffer piston 3, in other words, the gas is released to the outside. In consequence, operating energy applied to the puffer piston 3 is minimized, thereby enabling the movable electrode 21 to be moved toward the lever 9 at a fast speed.

After causing the puffer piston 3 to be shifted further in the direction of the arrow C to pass by the location of the differently enlarged external diametrical configuration of the puffer cylinder 2 as shown in FIG. 3, the arc cancelling chamber expands, so the inner space of the arc cancelling chamber 5 bears negative pressure to cause the insulating gas remaining between the movable electrode 21 and the contact 12 to be absorbed i.e., sucked, into the arc cancelling chamber 5 via the tip of the movable electrode 21. As insulating gas enters the tip of the movable electrode 21, insulating gas is drawn into the space S between the movable electrode 21 and the contact 12, in which the arc cancelling capability would otherwise be low, thus enabling to fully cancel the electric arc current generated in the heated portion S. While the tip of the movable electrode 21 under serial strokes moves through an area E shown in FIG. 4 while the puffer-type earthing switch 101 remains open, the electric arc current is generated in the space S. Accordingly, the electric arc current is effectively cancelled by the heated insulating gas drawn toward the tip of the movable electrode 21.

Figure 5:
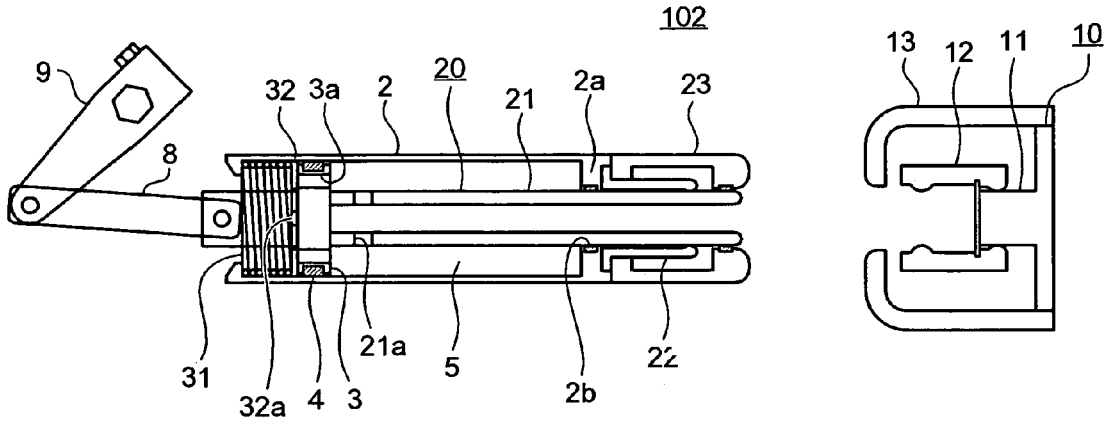
FIG. 5 is a side view of a puffer-type earthing switch according to a second embodiment of the present invention in a totally disconnected state.
Figure 6:
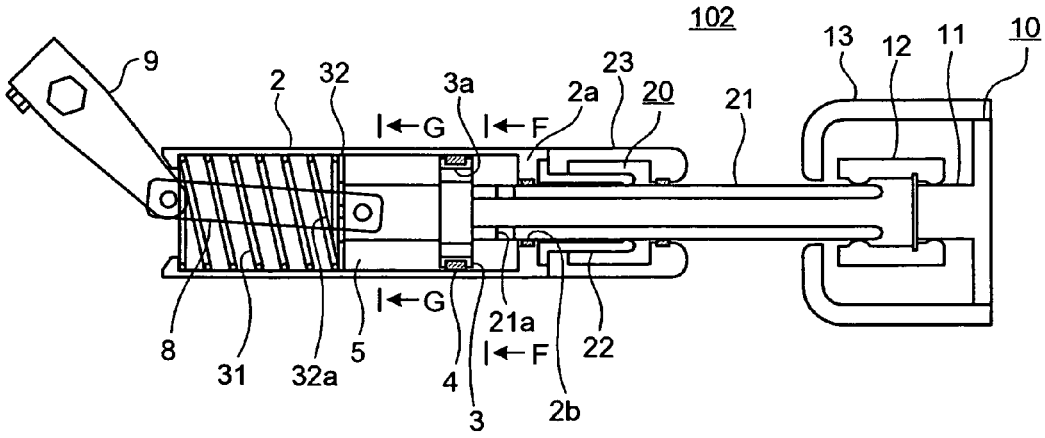
FIG. 6 is a side view of the puffer-type earthing switch shown in FIG. 5 in a fully actuated state.
Figure 7:
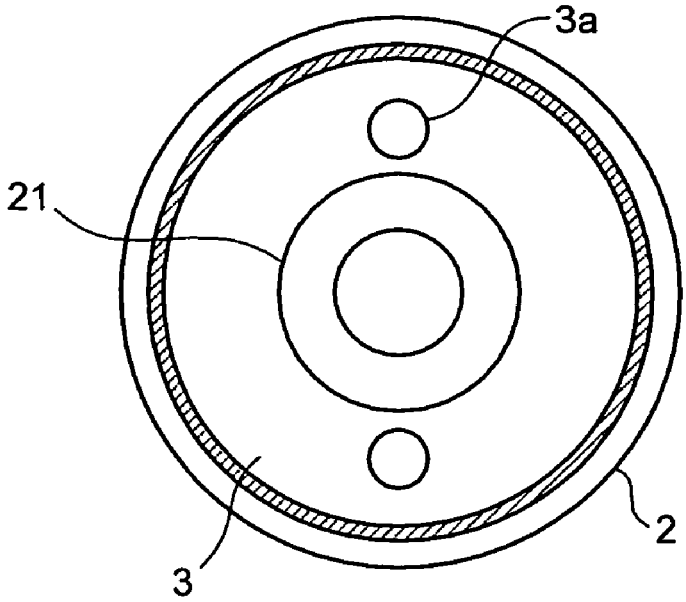
FIG. 7 is a cross-sectional view of the puffer-type earthing switch shown in FIG. 6 along line F-F and as seen in the direction indicated by corresponding arrow marks.
Figure 8:
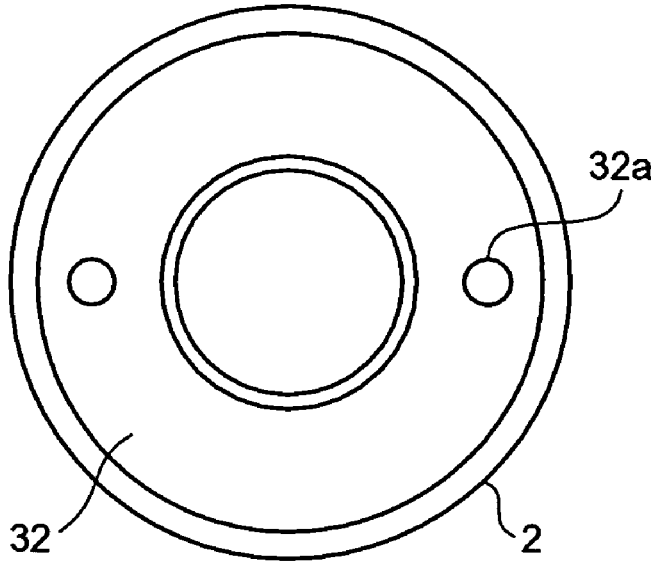
FIG. 8 is a cross-sectional view of the puffer-type earthing switch shown in FIG. 6 along line G-G and as seen in the direction indicated by corresponding arrow marks.

FIG. 5 is a side view of a puffer-type earthing switch 102 according to a second embodiment of the present invention in a totally disconnected state. FIG. 6 is a side view of the puffer-type earthing switch 102 in a fully actuated state. FIG. 7 is a cross-sectional view of the puffer-type earthing switch 102 along line F-F and as seen in the direction indicated by corresponding arrow marks. FIG. 8 is a cross-sectional view of the puffer-type earthing switch 102 along line G-G and as seen in the direction indicated by corresponding arrow marks.

The puffer-type earthing switch 102 includes a coiled spring 31 housed inside the puffer cylinder 2 and a valve unit 32 provided for the coiled spring 31 and the puffer piston 3. An end of the helically configured coiled spring 31 is secured to an end of the lever 9 adjoining the puffer cylinder 2. The valve unit 32 is secured to the other end of the coiled spring 31. The disc-form valve unit 32 has a couple of through-holes 32*a*, which are disposed at the positions opposite from each other across the axial line as shown in FIG. 8. On the other hand, as shown in FIG. 7, the puffer piston 3 is also provided with a couple of through-holes 3*a*, which are disposed at the positions opposite from each other across the axial line. These through-holes 32*a* and 3*a* are disposed at the opposite positions 90 degrees apart from each other in the circumferential direction.

As shown in FIG. 5, when the valve unit 32 is closely attached to the puffer piston 3, since the through-holes 32*a* and 3*a* are closely sealed by the main surfaces of the valve unit 32 and the puffer piston 3, the insulating gas is totally deterred from infiltration through them. Conversely, as shown in FIG. 6, when the puffer piston 3 leaves the valve unit 32, the through-holes 32*a* and 3*a* are opened to enable the insulating gas to flow through them. Concretely, while being abutted with the puffer piston 3, both the valve unit 32 and the through-hole 3*a* are closed, whereas when the valve unit 32 and the through-hole 3*a* are apart from the puffer piston 3, both the valve unit 32 and the through-hole 3*a* are respectively released.

Due to the above configuration, in the area subject to compressive force of the coiled spring 31 within a full stroke extent of the movable electrode 21, pressure stored in the arc cancelling chamber 5 turns to be higher or into the negative level to actuate a puffering function. On the other hand, after causing the coiled spring 31 to be fully extended to enable the puffer piston 3 to leave the valve unit 32, the arc cancelling chamber 5 is opened to reduce the pressure therein down to a level substantially equivalent to the peripheral atmosphere, thereby causing the puffering function to become no longer operable.

The puffer-type earthing switch 102 is able to achieve the same effects that are achieved with the puffer-type earthing switch 101. Further, when the second mode is applied, the puffer piston 3 is energized in the direction of the stationary contact unit 10 by the coiled spring 31 while the actuating operation is still underway. Accordingly, this enables the movable electrode 21 to be shifted in the direction of the stationary contact unit 10 at a faster speed. Because an additional input operation is executed at a faster speed, the short circuit input performance during the input actuating process can be further enhanced.

Figure 9:
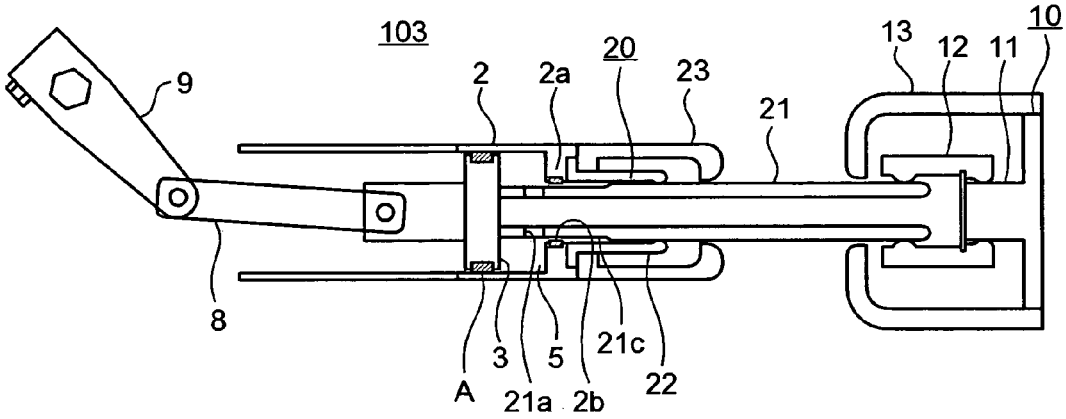
FIG. 9 is a side view of a puffer-type earthing switch according to a third embodiment of the present invention in a fully actuated state.

FIG. 9 is a side view of a puffer-type earthing switch 103 according to a third embodiment of the present invention in a fully actuated state. The gas container 1 has not been shown in FIG. 9. In the puffer-type earthing switch 103, the release mechanism is so arranged that a predetermined area is configured with a small diameter at a local portion that penetrates the facet 2*a* of the puffer cylinder 2. The remaining configuration is quite similar to that of the puffer-type earthing switch 101.

Like the one provided for the first practical mode, the movable electrode 21 is of the cylindrical configuration having an end secured to the puffer piston 3 and the other end projecting itself from the hole 2*b* that is formed through the facet 2*a* of the puffer cylinder 2 located in opposition from the stationary contact unit 10. The puffer-type earthing switch 103 causes the insulating gas to be absorbed into and blown out from the tip portion of the stationary contact unit 10 via the holes 21*a* formed in the puffer piston 3. The puffer-type earthing switch 103 enables the arc cancelling chamber 5 to be opened and is provided with a small-diameter portion 21*c* having a small diameter along a predetermined length in the direction of the stationary contact unit 10 across an end of the movable electrode 21 on the puffer piston 3.

When the small-diameter portion 21*c* arrives at the position of the hole 2*b*, insulating gas stored in the arc cancelling chamber 5 blows out through the clearance between the small-diameter portion 21*c* and the hole 2*b* in the direction of the contact 22. Note that, in order to free the insulating gas, a sealing member is provided that seals the intermediate portion between the shield 23 and the movable electrode 21. By virtue of this arrangement, within a full stroke extent of the movable electrode 21, pressure stored in the arc cancelling chamber 5 turns to be higher or into the negative level in the area devoid of the small-diameter portion 21*c*, thereby actuating the puffering function. On the other hand, the arc cancelling chamber 5 is released in the area having the small-diameter portion 21*c* to cause the pressure remaining in the arc cancelling chamber 5 to become equivalent to the peripheral atmosphere, thus disabling the puffering function.

Effect similar to those that can be achieved with the puffer-type earthing switch 101 can be achieved with the puffer-type earthing switch 103. Because the release mechanism is realized by a simple configuration by way of partially contracting the diameter of the movable electrode 21, it is advantageous for realizing the cost reduction.

Figure 10:
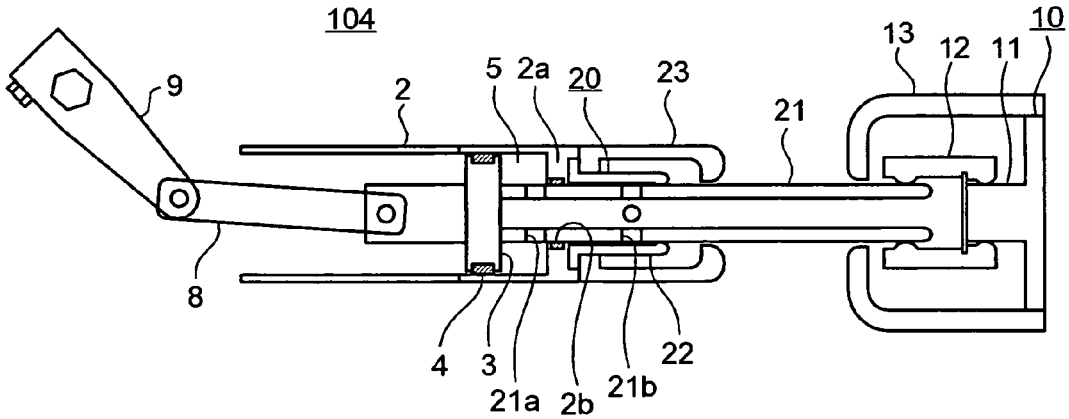
FIG. 10 is a side view of a puffer-type earthing switch according to a fourth embodiment of the present invention in a totally disconnected state.
Figure 11:
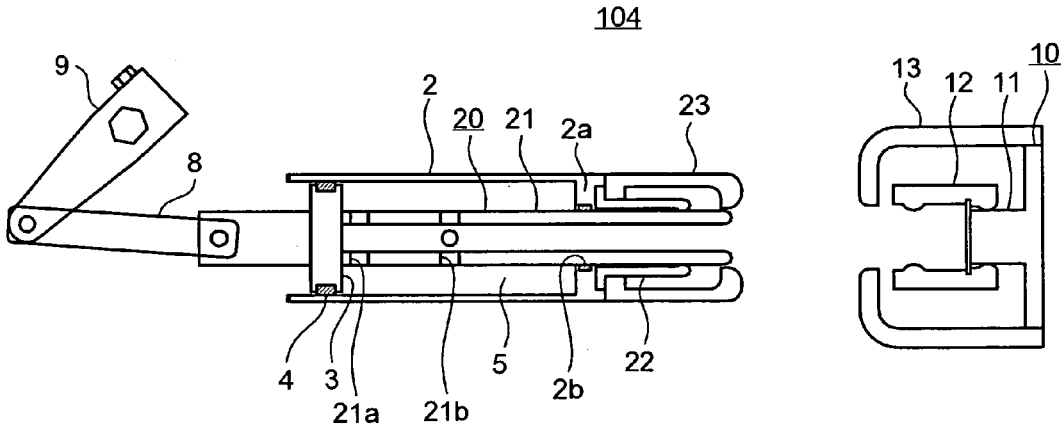
FIG. 11 is a side view of the puffer-type earthing switch shown in FIG. 10 in a fully actuated state.

FIG. 10 is a side view of a puffer-type earthing switch 104 according to a fourth embodiment of the present invention in a totally disconnected state. FIG. 11 is a side view of the puffer-type earthing switch 104 in a fully actuated state. The gas container 1 has not been shown in FIGS. 10 and 11 for the sake of simplicity. The puffer-type earthing switch 104 is provided with a release mechanism, which includes holes 21*b* formed at a location closer to the stationary contact unit 10 than the holes 21*a* provided for the movable electrode 21. Other configurations are quite similar to those which are provided for the first practical mode.

The movable electrode 21 includes the cylindrical configuration having an end being secured to the puffer piston 3 and the other end projecting itself from the hole 2*b* formed through the facet 2*a* of the puffer cylinder 2 at a location opposite from the stationary contact unit 10. The movable electrode 21 is configured with a system that causes insulating gas to be absorbed therein and emitted externally from the tip portion of the stationary contact unit 10 via the holes 21*a* formed at an end of the puffer piston 3. To realize a release mechanism for releasing the arc cancelling chamber 5, the holes 21*b* are formed at a predetermined location, which is apart from the holes 21*a* by a predetermined distance and present at a spot closer to the stationary contact unit 10 than the first holes 21*a* formed in the movable electrode 21.

When the holes 21*b* arrive at a position closer to the stationary contact unit 10 than the hole 2*b*, insulating gas stored in the arc cancelling chamber 5 blows to the outside toward the contact 22 in order of the first holes 21*a*, internal space of the movable electrode 21, and the holes 21*b*. Note that, in order to free the insulating gas, the puffer-type earthing switch 104 is provided with a sealing member that seals the intermediate portion between the shield 23 and the movable electrode 21. By virtue of this arrangement, in the area in which the holes 21*b* are located at a spot closer to the lever 9 than the hole 2*b* within a full stroke extent of the movable electrode 21, pressure stored in the arc cancelling chamber 5 turns to be higher or into the negative level so as to actuate the puffering function (refer to FIG. 11). On the other hand, in the area in which the holes 21*b* is located at a spot closer to the stationary contact unit 10 than the hole 2*b*, the arc cancelling chamber 5 is released to cause the pressure remaining in the arc cancelling chamber 5 to become substantially equivalent to the peripheral atmosphere, thus disabling the puffering function (refer to FIG. 10).

The puffer-type earthing switch 104 achieves effects that are identical to those of the puffer-type earthing switch 101. Further, because the release mechanism is realized by a simple method that provides the holes 21*b* for the movable electrode 21, cost reduction can be facilitated.

Figure 12:
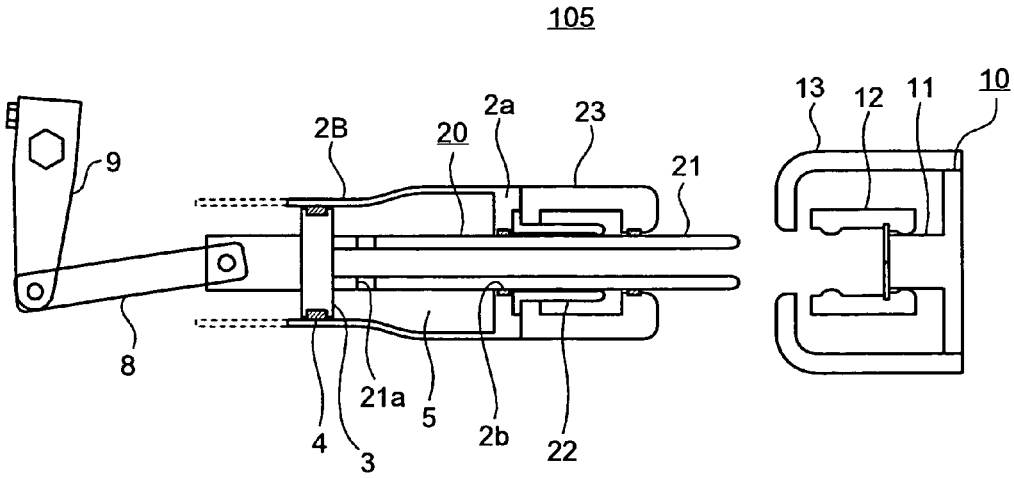
FIG. 12 is a side view of a puffer-type earthing switch according to a fifth embodiment of the present invention at the time of the first half cycle of an actuating operation.

FIG. 12 is a side view of a puffer-type earthing switch 105 according to a fifth embodiment of the present invention at the time of the first half cycle of an actuating operation. The gas container 1 has not been shown in FIG. 12 for the sake of simplicity. The puffer-type earthing switch 104 is provided with the second release mechanism in addition to the release mechanism that applies the puffer cylinder 2 having the external-diameter portion configured with a differently enlarged diameter like the one adopted for the first practical mode cited earlier. In the second release mechanism, length of the puffer cylinder 2 is contracted to be shorter than the stroke extent of the movable electrode 21. The portions indicated by dotted lines shown in FIG. 12 correspond to the objective portions deleted for the sake of forming the second release mechanism. Puffering function is inoperable in the portions from which the puffer cylinder 2 is deleted.

The second release mechanism releases the arc cancelling chamber 5 within an area closer to the lever 9 than the arc-generating area synchronously with the contacting and detaching movements performed between the stationary contact unit 10 and the movable contact unit 20 within a full stroke extent of the movable electrode 21. Refer to the local area B shown in FIG. 1 and the local area E shown in FIG. 4. In other words, a specific area that disables the puffering function is formed in the arc generating area closer to the stationary contact unit 10 and on both sides of the arc generating area closer to the lever 9. By virtue of this arrangement, unwanted electric arc current can effectively be cancelled, and further, an actuating operation can be executed faster, thereby further enhancing the short circuit input performance during the system actuation.

In addition to the release mechanism having the puffer cylinder 2 provided with the differently enlarged external diametric configuration for realizing the first embodiment, the puffer-type earthing switch according to the fifth embodiment incorporates the second release mechanism. However, the scope of the present invention is not solely limited to this configuration, but it is also practicable to combine the second release mechanism with anyone of the release mechanism adopted for realizing the second, third, and fourth embodiments.

According to an aspect of the present invention, a release mechanism is provided, which is arranged to disable a puffering operation via release of pressure stored in a arc cancelling chamber by releasing the chamber in a predetermined area toward a stationary contact unit within a full stroke extent of a movable contact unit. Due to such an arrangement, the puffer-type earthing switch realized by the present invention is enabled to perform an arc cancelling operation at a proper location during the actuating operation and also in the course of releasing the puffer-type earthing switch itself. This arrangement enables operating energy to be minimized in the latter half cycle of the actuating operation, thereby securely accelerating the actuating speed of the puffer-type earthing switch according to the present invention.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An earthing switch comprising:

a container filled with insulating gas;

a stationary contact unit firmly secured to an interior of the container;

a movable contact unit, an end of which is capable of moving toward or away from the stationary contact unit;

a lever coupled with other end of the movable contact unit;

a puffer cylinder that is arranged coaxially around the movable contact unit;

a puffer piston integrated with the movable contact unit and defines an arc cancelling chamber in conjunction with the puffer cylinder, wherein the puffer piston slides along the inner wall surface of the puffer cylinder in the axial direction so as to exert a puffing function when the movable contact unit is retracted from the stationary contact unit by expanding the arc cancelling chamber to cause insulating gas to be drawn into the arc cancelling chamber through a clearance between the movable contact unit and the stationary contact unit wherein insulating gas flowing through the clearance exerts the puffering function, and also to exert the puffing function when the movable contact unit is moved toward the stationary contact unit by contracting the arc cancelling chamber to cause insulating gas in the arc cancelling chamber to blow out from the arc cancelling chamber and pass through a clearance between the movable contact unit and the stationary contact unit; and a release mechanism that releases pressure stored in the puffer type arc cancelling chamber by releasing the pressure when the movable contact lies within a predetermined region of its movement during a full stroke extent of the movable contact unit so that the puffering function is terminated when the movable contact unit lies within that predetermined region.

2. The earthing switch according to claim 1, wherein the predetermined region of movement is located such that the movable contact unit travels therein following the generation of an arc current during movement of the movable contact unit both toward and away from the stationary contact unit.

3. The earthing switch according to claim 1, wherein the release mechanism includes the puffer cylinder with a first portion toward the stationary contact unit having a first diameter and a second portion toward the lever having a second diameter, the first diameter being greater than the second diameter.

4. The earthing switch according to claim 1, wherein the release mechanism includes a coiled spring having an end secured to an end of the puffer cylinder toward the lever and a valve unit that is disposed to the other end of the coiled spring, wherein the valve unit is closed while remaining in contact with the puffer piston and released when being disengaged from the puffer piston.

5. The earthing switch according to claim 1, wherein the movable contact unit is cylindrical with one end being secured to the puffer piston and other end projecting from a facet of the puffer cylinder, wherein insulating gas enters into the movable contact unit and the insulating gas is blown to outside via a hole formed through an end of the puffer piston, wherein the release mechanism has a small diameter portion, in which a portion corresponding to a predetermined area within a local portion that penetrates the facet of the puffer cylinder present in the movable contact unit is formed with a small diameter.

6. The earthing switch according to claim 1, wherein the movable contact unit is hollow and cylindrical with one end being secured to the puffer piston and other end projecting from the facet of the puffer cylinder, wherein the movable contact unit conducts insulating gas to and from the arc cancelling chamber via a first hole formed through the movable contact unit, wherein the release mechanism has a configuration including at least one second hole formed in the movable contact unit closer to the stationary contact unit than the first hole.

7. The earthing switch according to claim 1, further comprising a second release mechanism that releases the arc cancelling chamber in an area closer to the lever than the area in which an arc current is generated via the movement of the movable contact unit during a full stroke extent of the movable contact unit.

8. The earthing switch according to claim 7, wherein the second release mechanism has a configuration in which a portion of the puffer cylinder toward the lever is shorter than a stroke length of the movable contact unit.

* * * * *